US005873182A

United States Patent [19]

Fuller

[11] Patent Number: 5,873,182

[45] Date of Patent: Feb. 23, 1999

[54] KILN CONTROL BASED ON CHANGING SHRINKAGE RATE

[76] Inventor: James J. Fuller, 3048 Acker St., Cross Plains, Wis. 53528

[21] Appl. No.: 647,496

[22] Filed: May 14, 1996

[51] Int. Cl.[6] ..... F26B 13/10

[52] U.S. Cl. ..... 34/527; 34/495

[58] Field of Search ..... 34/524, 527, 191, 34/446, 218, 491, 493, 495–565

[56] References Cited

U.S. PATENT DOCUMENTS

| | | | |
|---|---|---|---|
| 1,593,890 | 7/1926 | Welch . | |
| 3,744,144 | 7/1973 | Weis . | |
| 4,176,464 | 12/1979 | Randolph . | |
| 5,197,201 | 3/1993 | Salin | 34/16.5 |
| 5,226,241 | 7/1993 | Goodwin . | |
| 5,325,604 | 7/1994 | Little . | |

OTHER PUBLICATIONS

"Application of Computer Technology toi Kiln–Drying Process Control", Conference advertisement, John L. Hill et al, University of New Hampshire, May 1995.

"Potential Use of a Semi–Ring Extensometer for Continuous Wood Surface Strain Measurement During Lklln Drying" Fortin et al, 4th IUFRO International Wood Drying Conference, Rotorua, New Zealand, pp. 329–336, 1994.

"Shrinkage–Strain–Control (S–S–C)—A New Approach to the process of Kiln–Drying Wood", Bello et al, Wood Science vol. 7, No. 3, Jan. 1975.

Hill, Application of Computer Tech . . . May 1995.

Bello et al, Shrinkage–Strain Control . . . Jan. 1975.

Fortin et al, Potential Use of a Semi–Ring . . . 1992.

*Primary Examiner*—William Doerrler

*Attorney, Agent, or Firm*—Notaro & Michalos P.C.

[57] ABSTRACT

A real-time process and apparatus for controlling conditions in a lumber drying kiln include measuring the shrinkage of a sample of the lumber across the longitudinal axis of the lumber and over time. A slope of the curve is analyzed and can be used to determine when a stress peak and stress reversal occurs in the lumber sample. The detection of the stress peak indicates that the drying schedule of the kiln should be incremented to the next drying step. According to the invention, the schedule is incremented in the fastest possible way without degrading the quality of the lumber.

14 Claims, 11 Drawing Sheets

KILN CONTROL BASED ON CHANGING SHRINKAGE RATE

STATEMENT OF GOVERNMENT INTEREST

The Government may have certain non-exclusive rights to this invention for Government purposes.

FIELD AND BACKGROUND OF THE INVENTION

The present invention relates in general to the control of kilns used for drying wood, and in particular to a new and useful method and apparatus for controlling a wood drying kiln which is based on changes of the shrinkage rate in one or more boards of the lumber charge. In accordance with the invention, this information is used to determine internal stress levels in the board which in turn can be used to identify the occurrence of peak stress, stress reversal and reduced shrinkage as the drying rate is reduced after an initial increase of the drying rate during each advancement of the kiln schedule.

Kilns have long been used to dry lumber, in particular hardwood, but also some softwoods, with multiple step schedules. It is also known to periodically change the internal conditions of temperature and humidity in a kiln, according to a manual or automated schedule for the purpose of maximizing the drying while minimizing damage to the lumber in case the moisture content is reduced too quickly.

This balancing of maximum drying rate and the need to avoid damage to the wood, is the subject of several patents and articles.

Presently kiln controls are based on a number of parameters such as electrical resistance of the lumber (U.S. Pat. No. 3,744,144), weight of the lumber (U.S. Pat. Nos. 1,593,890; 4,176,464; 5,226,241; 5,325,604), internal temperature of the lumber, air temperature decrease across the stack of lumber, or length of drying time. All are used to indicate the moisture content of the lumber. This inferred moisture content is an indirect and poor indicator of the internal stresses which are ultimately the key to drying efficiently while providing quality lumber. Further, all of the above methods have weaknesses which reduce accuracy in determining the true moisture content of the load.

Board shrinkage has also been examined by Fortin, et al. in 1994 for example, but it was stated that an abrupt change in slope in shrinkage curves that were used, were due to the occurrence of fiber saturation point (FSP). See Fortin, Y., M. Ilieva, A. Cloutier, and P. Laforest. 1994, "Potential use of a semi-ring extensiometer for continuous wood surface strain measurement during kiln drying." 4th IUFRO International Wood Drying Conference August 9–13th, 1994 Roturua, New Zealand. Ed. by A. Haslett and F. Laytner, pages 329–336. The error in their conclusions were precipitated by the absence of any stress data collected and reliance on the traditional moisture content orientation of drying research. They also did not mention how the data could be used to automate the kiln process.

Fiber point saturation is not meaningful when considering average moisture content. It refers to a time when a cell wall in the wood contains the maximum amount of water but has no free water in the cell lumen. Stress reversal has been recorded to occur an at any board average moisture content between 60% and 30% (percentages in this disclosure are all by oven dry weight). The reason it occurred at about 33% for the researchers mentioned above is that they were using a particular schedule on a species which generally causes stress reversal to occur at about 30%. They did not realize that the abrupt change in slope they observed is caused directly by stress reversal, not moisture content. For this reason, the work of Fortin, et al. 1994, has not helped to progress automated kiln control.

Bello and Kubler (1975) developed a shrinkage verses fracture-strain theory based on the comparison of true surface shrinkage and fracture strain of the material. By knowing the experimentally determined average fracture strain of the material and temperature, a theoretical loss of moisture can be calculated whereby the shrinkage is less than the average fracture strain. When this moisture is lost, a new data set of moisture and temperature set points can be calculated to advance the schedule. A drawback to this theoretical system is that the kiln sample boards would still be used to monitor moisture loss. Another drawback to this method is the need to know beforehand the average fracture strain of the material which is variable from board to board, a reversion back to the traditional manual method. See Bello, E. and H. Kubler 1975 "Shrinkage-strain-control (S-S-C)—A new approach to the process of kiln-drying wood" Wood Science 7(3):191–197.

A second point mentioned in the Bello and Kubler article is shrinkage referred to in a paper by McMillen (1969). In the original paper, McMillen labels his graphs as shrinkage but refers to them in the caption as plastic strain (which they actually are) and not shrinkage. The curves are for released plastic strain of individual layers from a board, not an entire board or gross shrinkage as is measured by the present invention. The destructive, time-consuming method of slicing the board and measuring the released strain was only conceived as a research tool to measure stress gradients within a board and was never intended as a monitoring method.

Hill, in 1975, performed a study to measure "barreling" or "bulging" of the side edge of lumber to infer stress levels. He was never able to obtain repeatable results that could be used as a control device. See Hill, J., 1996, Personal communication, Apr. 26, 1995. Referring to the drawings, FIGS. 15, 16, 17, illustrate Hill's device. Hill also only sought to detection stress reversal, not peak stress nor reduced drying rates. Hill advocated a system which measures the moisture contain difference between the surface and center of the board to obtain a theoretical stress level. He assumed stresses develop after 30% moisture content has been reached. In contrast, shrinkage can develop as high as 60% moisture content. Hill's system thus is not an actual stress level monitoring device.

In Hill's device, a frame 1 includes a centrally located feeler mechanism 2 having a probe tip 3 for contacting the side edge of a board. The frame is held to the edge of the board by screws 5 and the differential between the longitudinal position of feeler 3 and fixed reference plate pins 4 measures the relative amount of bulging or cupping of the board edge.

Although Hill's system is a real-time system, the moisture stress gradient is based on moisture content and the differential shrinkage obtained by measuring the bulging and cupping at the edge of the board, is a strain measurement and does not reveal peak stress points in the board, which is a main consideration and preferred for the present invention.

SUMMARY OF THE INVENTION

The Invention is a method and apparatus for controlling a lumber drying kiln, based on detecting the slope of a long term shrinkage curve and the slope of a short term shrinkage curve. Upon detecting a crossing of these two curves, which indicates a stress-reversal, the kiln setting changed to the next drying stage. The shrinkage curves are generated using an apparatus which is attached to a board of the lumber charge, for detecting a change in the length or shape of the board.

Accordingly, another object of the invention is to provide a real-time process and apparatus for controlling conditions in a lumber drying kiln, comprising measuring a selected characteristic of a sample of lumber in the kiln, over time, the selected characteristic being indicative of stress in the sample, such as shrinkage, and analyzing the measured characteristic to determine when a stress peak or stress reversal has occurred in the sample. The conditions in the kiln and changed when the stress peak or stress reversal has occurred, to advance the drying of the lumber.

A further object of the present invention is to provide a method and apparatus for improving the advancement of a kiln schedule, which is simple in designed, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which the preferred embodiments of the invention are illustrated.

DESCRIPTION OF THE PREFERRED EMBODIMENTS

The present invention involves the detection of changes in internal stress in lumber during drying, by measuring changes in the external dimensions of one or more boards in the lumber load in a kiln. These changes are used to automatically advance the dry kiln schedule.

The invention is a method and apparatus that measures material shrinkage by which internal stress level can be directly inferred. The following three events are determined: 1) occurrence of peak stress; 2) stress reversal; and 3) reduced shrinkage as the drying rate is reduced after initial increase of drying rate with each advancement of the kiln schedule.

For the detection of these occurrences, the apparatus is connected to a computer with a simple program requiring minimal input by the kiln operator.

Unlike typical schedules which advance the kiln settings based on moisture content, the present invention detects changes of slope in the shrinkage curve created from the electronic input data from the shrinkage device. Upon the occurrence of significant slope change, advancement of the kiln schedule proceeds. This early advancement saves time and energy and avoids human error in judgment. The apparatus is inexpensive and represents considerable savings for the typical kiln owner in time, energy and lumber damage.

Theory of operation

The present invention has been verified by eight kiln loads, with different species, grain orientation, and position within the kiln. The examples disclosed here are representative.

Figure 8:
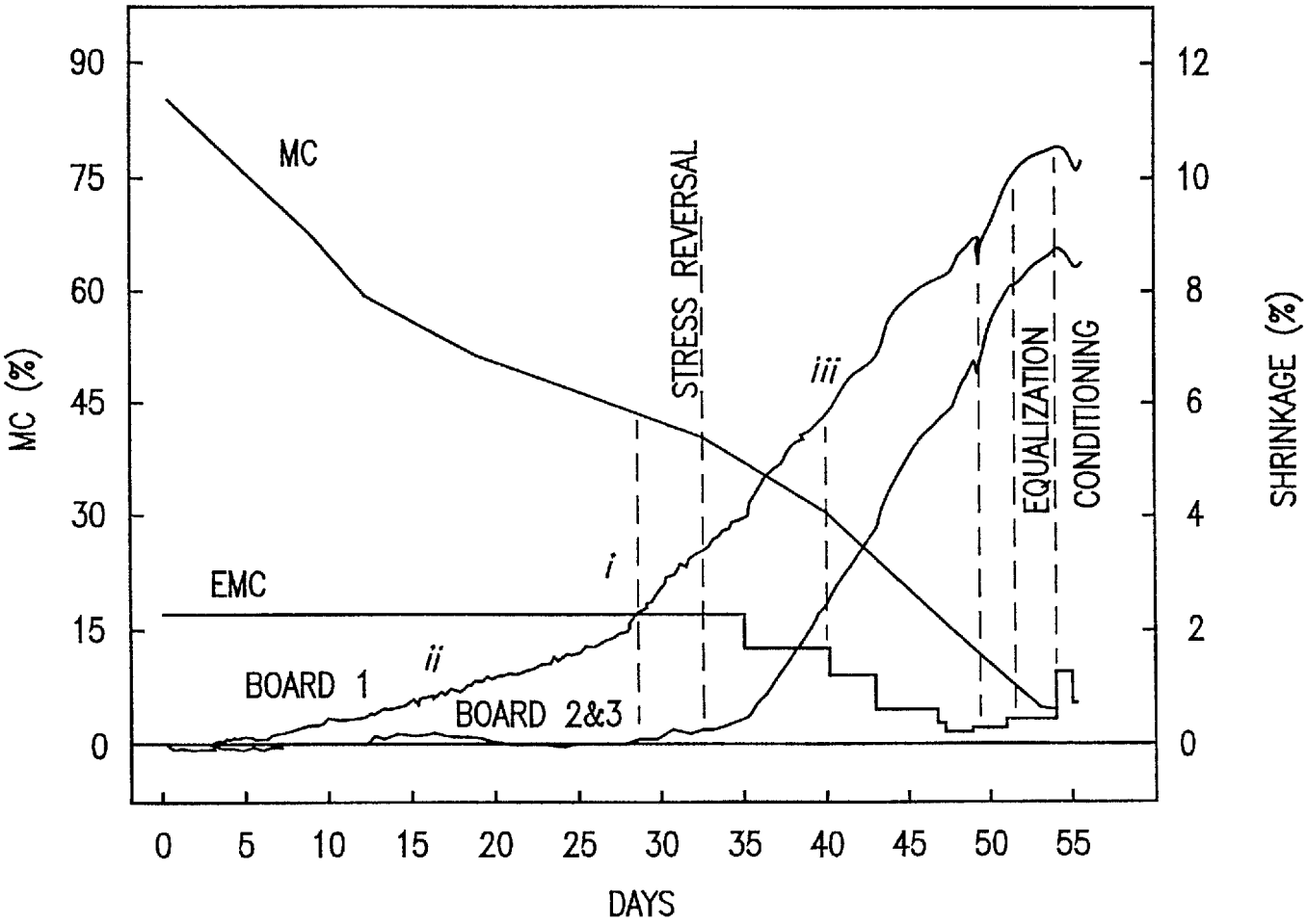
FIG. 8 is a graph plotting average moisture content, shrinkage and equilibrium moisture content against time for various oak loads.
Figure 9:
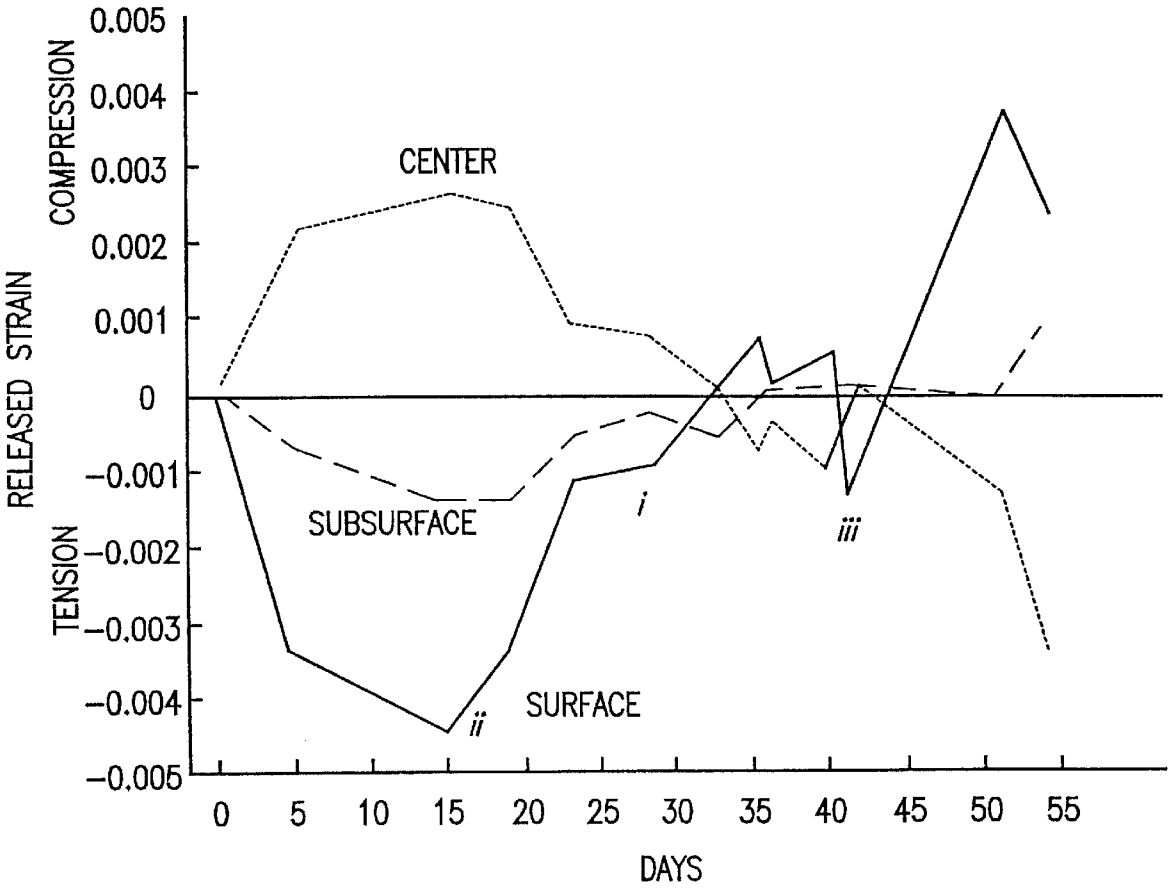
FIG. 9 is a graph plotting released strain against time for the loads of FIG. 8.

FIG. 8 shows the results of the average moisture content (MC) for boards monitored during drying. The shrinkage of two boards, Board 1 and Board 2 (Board 3 was identical to Board 2), and the equilibrium moisture content condition of the kiln (EMC) were all examined. The shrinkage curves represent data taken every hour during the full drying period and every twenty minutes during conditioning at the end of the drying cycle. FIG. 9 displays the level of strain at three points of the boards. The dotted line shows results at the board center, the dash line at the board sub-surface and the solid line at the board surface.

As lumber dries, only the surface has potential to shrink, but it is restrained by the lumber core, resulting in a reduced observed shrinkage as displayed in FIG. 8. Therefore, a low rate of shrinkage occurs. This produces internal stress as shown in FIG. 9. When the core starts to shrink, the restrained potential surface shrinkage is released and the observed shrinkage rate increases. This occurs just before stress reversal at Point i, in FIGS. 8 and 9 (at about 28 days in the example given). To a lesser degree, another abrupt change in slope appears at Point ii, immediately after peak stress occurs (at about 15 days). This cannot be detected by visual observation of the shrinkage curve.

Figure 10:
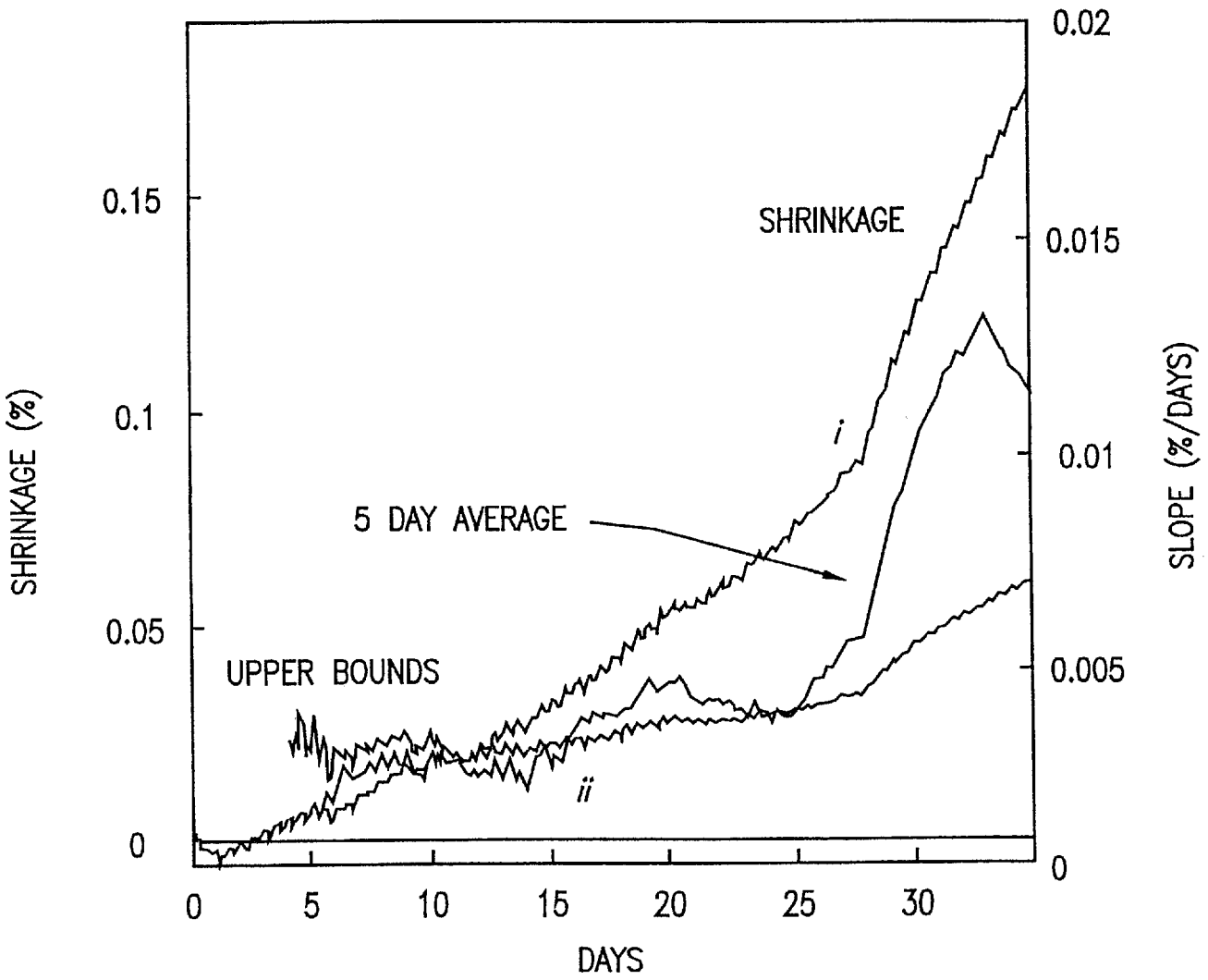
FIG. 10 is a graph plotting shrinkage and slope against time and illustrating the statistical decision making approach of the present invention.

A statistical analysis of the curve during drying is, however, can pick this point out and provide the necessary input to controls, as illustrated in FIG. 10. The detection of Point ii enables the operator or computer program to advance the kiln schedule at a much earlier time than is typical.

After each advancement of the dry kiln schedule the shrinkage rate increases. See Point iii in FIG. 8.

A typical schedule is shown in Table 1.

TABLE 1

Typical dry kiln schedule showing multiple steps.

| Moisture | Kiln Conditions | |
|---|---|---|
| Content of the Wood | Dry-bulb Temperature | Wet-bulb Temperature |
| above 50% | 110 F. (43.5 C.) | 106 F. (41 C.) |
| 50 - 40% | 110 F. (43.5 C.) | 105 F. (40.5 C.) |
| 40 - 35% | 110 F. (43.5 C.) | 102 F. (39 C.) |
| 35 - 30% | 110 F. (43.5 C.) | 96 F. (25.5 C.) |
| 30 - 25% | 120 F. (49 C.) | 90 F. (32 C.) |
| 25 - 15% | 135 F. (57.2 C.) | 90 F. (32 C.) |
| 15 - % | 180 F. (82 C.) | 130 F. (54.5 C.) |
| Equalization | 180 F. (82 C.) | 140 F. (66 C.) |
| Conditioning | 180 F. (82 C.) | 170 F. (76.5 C.) |

As the drying progresses, the rate of moisture loss decreases therefore shrinkage decreases. This decrease in shrinkage rate along with peak stress and stress reversal, not moisture loss, is detected by the present patent.

Both of these occurrences allow advancement of the dry kiln schedule prior to such an advancement being indicated by the moisture content of the kiln sample; the traditional method of monitoring the lumber and advancing the schedule. With advancement of the schedule taking place sooner because of shrinkage rate data and its indication of peak stress and stress reversal, the resident time of the charge is reduced. With reduced resident time, energy consumption is reduced without degrading lumber quality.

A computer program to be used with the invention for processing the shrinkage data, operates so that the length of the instantaneous short term slope will be reduced, as the kiln schedule is advanced. This accounts for the successively shorter periods in the schedule as illustrated in curve EMC of FIG. 8. Since some species take a shorter time to dry than others, the slope length will automatically be set according for each species.

During eight test runs the following factors were shown to have no effect on the results; initial moisture content range of the boards within a test run; position within the kiln; and type of grains or temperature. Because fifty percent of the lumber dried in the United States is oak and oak is also the hardest domestic lumber to dry, the test species were predominately oak. Maple, being an easy species to dry, was also tested. It was shown to display the same characteristic shrinkage curve as oak did, indicating that both ring porous and diffuse porous species behaved similarly. See FIGS. 12 and 13. This is not surprising since all lumber dries in the same way, the surface first then the center. This sets up the same basic stress patterns during drying. Therefore the same shrinkage patterns develop in all species during drying. The present invention is based on measuring the material response resulting from drying stresses which are all based on the known fundamental behavior of lumber. The invention does not monitor the coincidental roughly parallel processes of moisture content reduction, as do moisture content based systems.

A pilot study was conducted involving a control load and two other loads, one faster than the other and advanced using the shrinkage as the control parameter. This involved closely inspecting 3,000 BDFT (board-feet) of red oak lumber after drying for quality, using a nondestructive ultrasonic analysis. The statistical analysis of the pilot charges and the control showed that there was no significant increase of drying defects in the pilot charges. The first pilot run had reduced visual quality compared to the control run. For the second pilot run, the initial advancement was delayed one day and had markedly superior visual quality as compared to the control run.

The drying times for the two pilot runs were reduced 27% and 36% respectively. This demonstrates that the present invention can reduce the drying time with no increase in defects.

Figure 11:
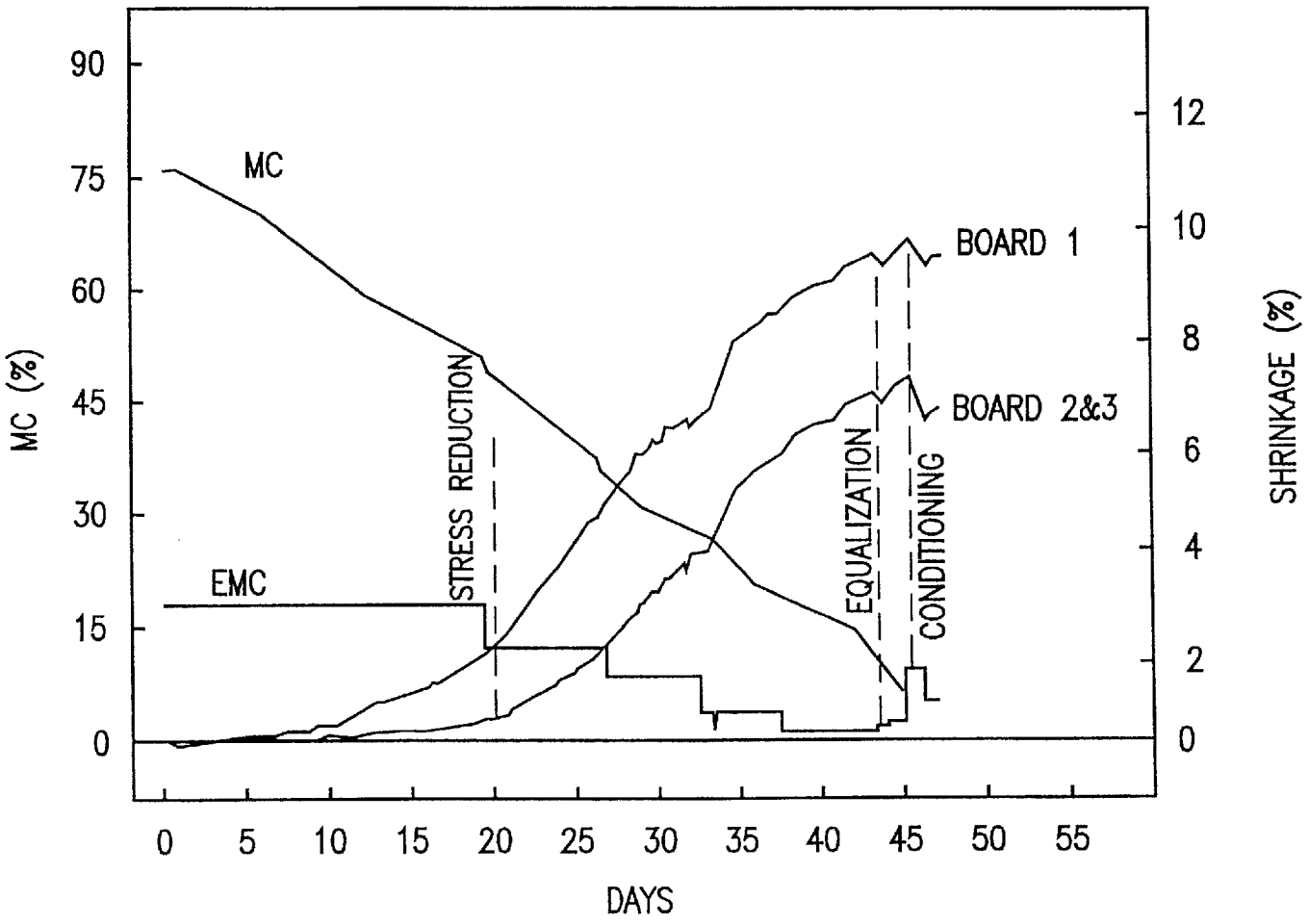
FIG. 11 is a graph similar to FIG. 8 but comparing the shrinkage of tangentially and radially oriented oak boards.
Figure 12:
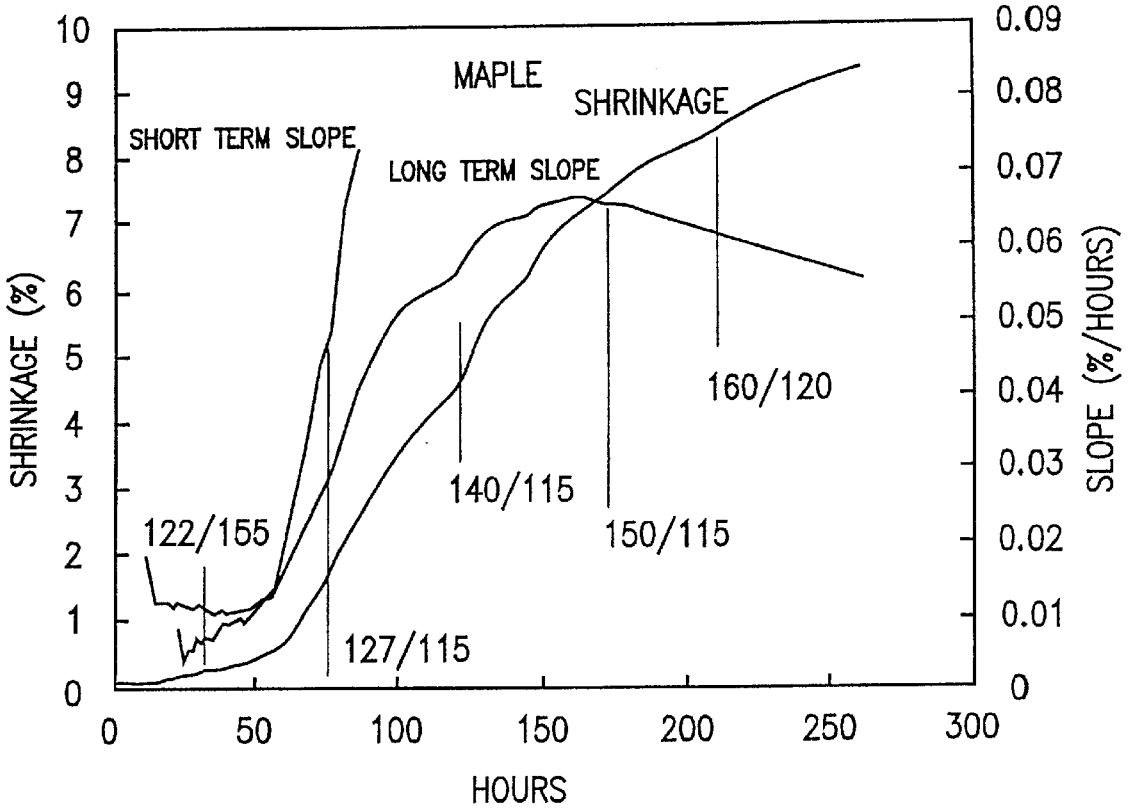
FIG. 12 is a graph similar to FIG. 10 for a maple load.
Figure 13:
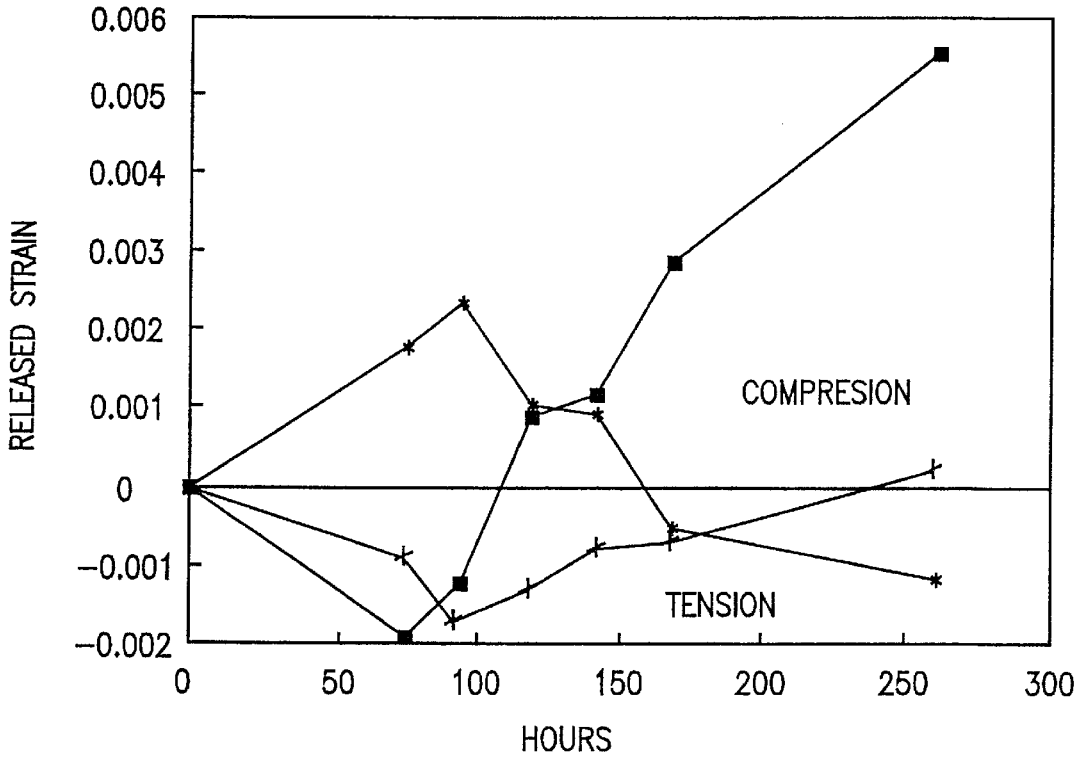
FIG. 13 is a graph similar to FIG. 9 for the maple load with schedule changes shown as #/#.
Figure 14:
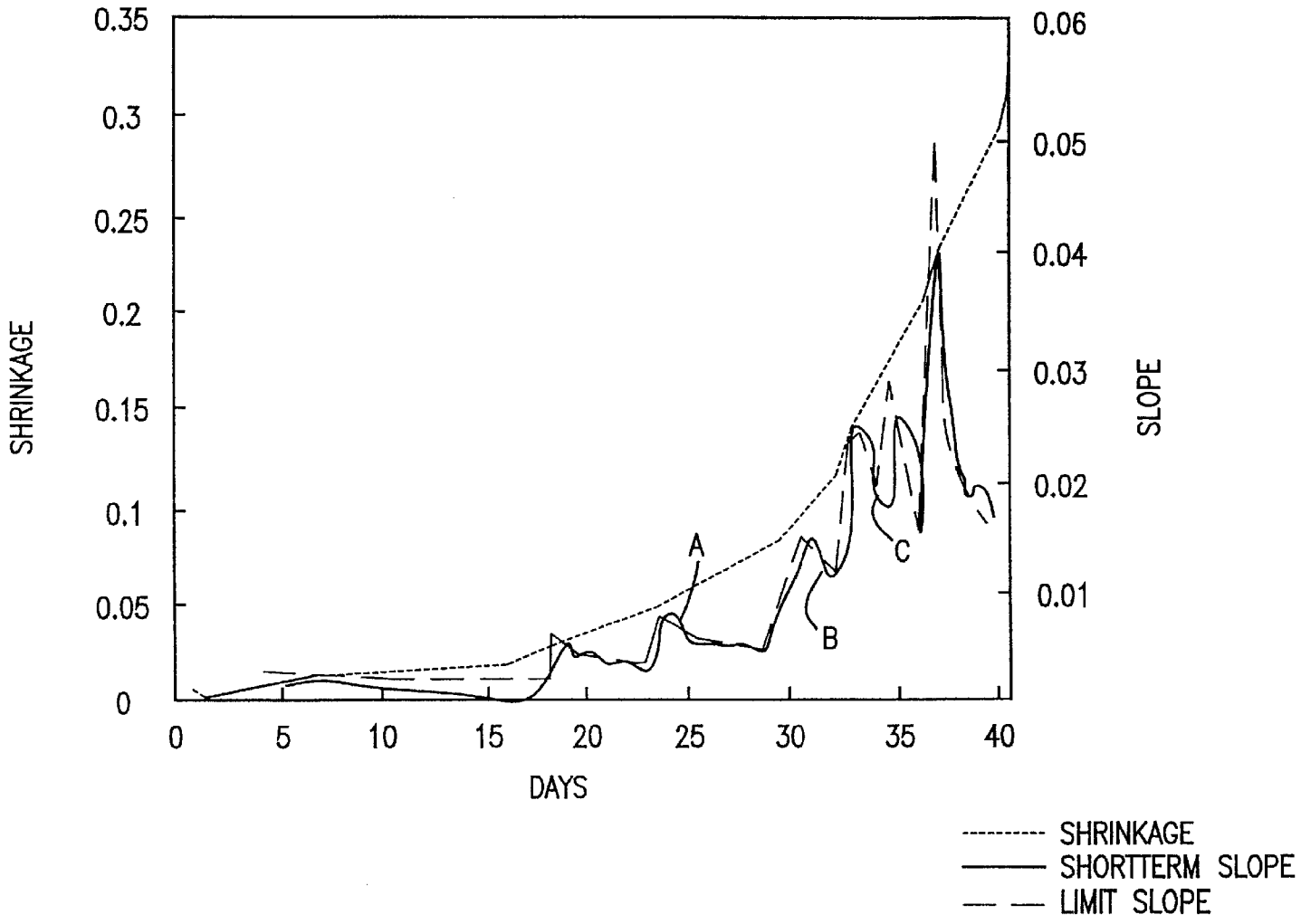
FIG. 14 is a graph plotting shrinkage and slope against time for a representative pilot run, illustrating long-term and instantaneous (short-term) slopes used for decision making according to the present invention.
Figure 15:
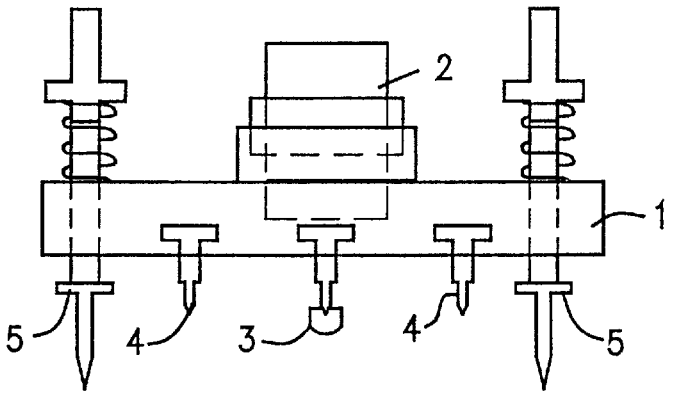
(PRIOR ART) FIG. 15
FIG. 15 is a side view of a prior art device taken in the direction of arrow 15 in FIG. 17.
Figure 16:
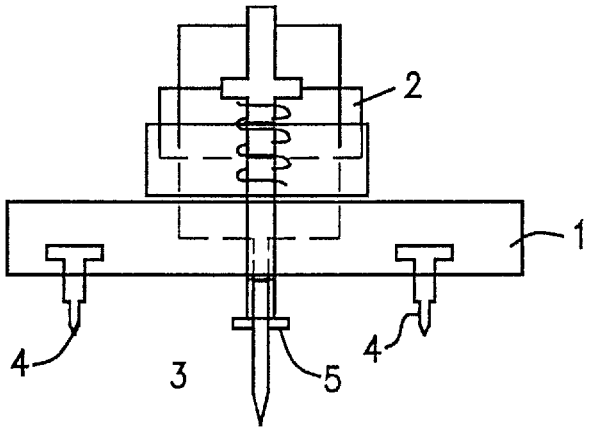
(PRIOR ART) FIG. 16
FIG. 16 is a bottom view of the prior art device taken in the direction of arrow 16 in FIG. 17.

Three additional red oak charges, one hard maple and three red oak charges for the comparative pilot study were run. FIG. 11 shows a charge which displays the difference in the curves for tangentially-oriented grain and radially-oriented grain. Both curves display the same general characteristic pattern on which stress levels can be seen. FIGS. 12 and 13 show the same characteristics for hard maple. FIG. 14 displays a shrinkage curve for one pilot run with the long term and instantaneous or short term slopes used for decision making.

Mechanical parts

Figure 1:
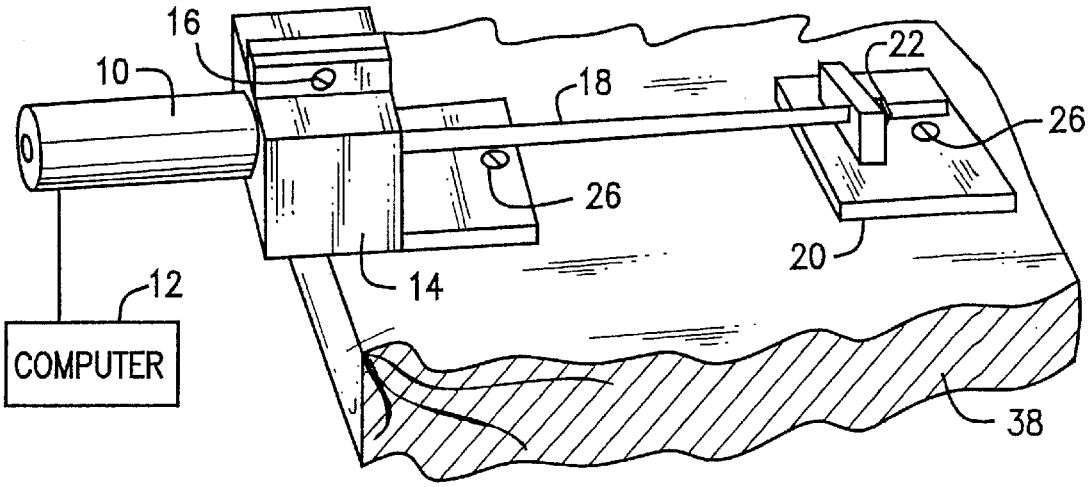
FIG. 1 is a perspective view of an apparatus of the present invention.
Figure 2:
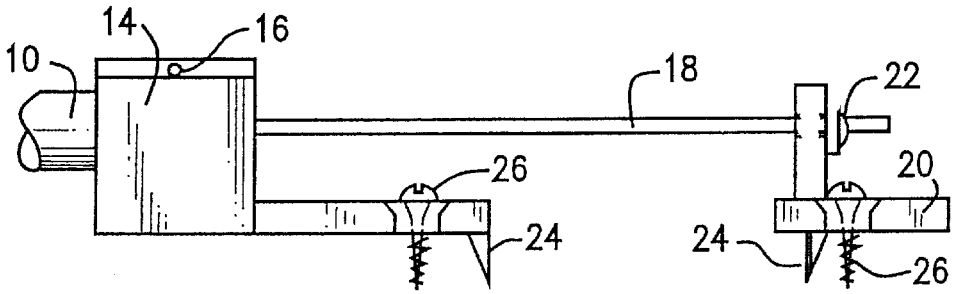
FIG. 2 is a side elevational view of two elements of the apparatus.

The apparatus of the invention includes four main mechanical parts as shown in FIGS. 1 and 2. The apparatus includes a Linear Variable Differential Transformer (LVDT) 10 for converting mechanical movement into electrical signals to a computer 12. The LVDT 10 is of known design and is mounted into a mounting bracket 14 by a set screw 16. The LVDT has a core rod 18 which extends into the LVDT 10 and which is attached to a second mounting bracket 20. The core rod 18 is locked into position relative to the mounting bracket 20 by a locking nut 22 to maintain accuracy. It is the relative movement between the core rod 18 and the LVDT 10 which produces the strain measurements. Both mounting brackets 14, 20 have a penetrating leg 24 which is driven into the surface of the board to produce a positive contact between the lumber and the LVDT assembly. Both mounting brackets also contain an elongated screw slot and screw 26 to attach the mounting brackets to the lumber and allow for any shrinkage between the screw and penetrating leg without allowing the legs 24 to be pulled from the board. This hardware may be plastic to avoid harm to saw blades during later use of the wood.

Figure 3:
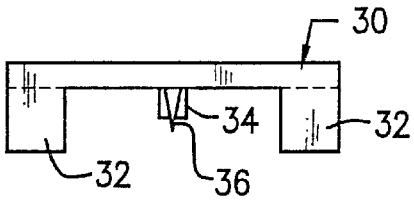
FIG. 3 is an end view of a bar for use in lining up the apparatus of the invention on a piece of lumber.
Figure 4:
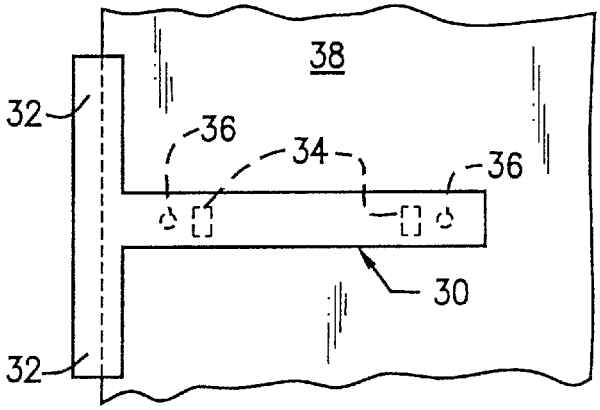
FIG. 4 is a top plan view of the bar on the lumber.

For the proper movement to occur, the mounting brackets must be aligned. To ensure such alignment a set-up bar was used. The bar, shown at 30 in FIGS. 3 and 4, has a pair of feet 32,32 which are held against the side edge of the lumber shown at 38, and then the bar is lightly hammered so that protrusions 36 and 34 are pressed into the lumber. The mounting brackets are correctly aligned because the screws 26 are placed in the holes left by protrusions 36 and the legs 24 are placed in the holes left by protrusions 34.

Brackets 14 and 20 are set on an upper surface of the board with rod 18 extending across the board from one side edge of the board toward the other, and exactly perpendicular to the long edge of the board, at a location away from the ends of the board.

Boards near the outer edge of the lumber charge in the kiln can be used with the shrinkage measuring apparatus, for convenience and accessibility. The LVDT 10 is by Trans-Tek and is referred to as the Displacement Transducer, with range 1 inch, DC-DC.

Any accurate measurement of external dimension or shape would give the same information pertaining to the internal stresses. Thickness shrinkage is one alternative parameter, as well as "barreling" of the lumber edge.

Figure 5:
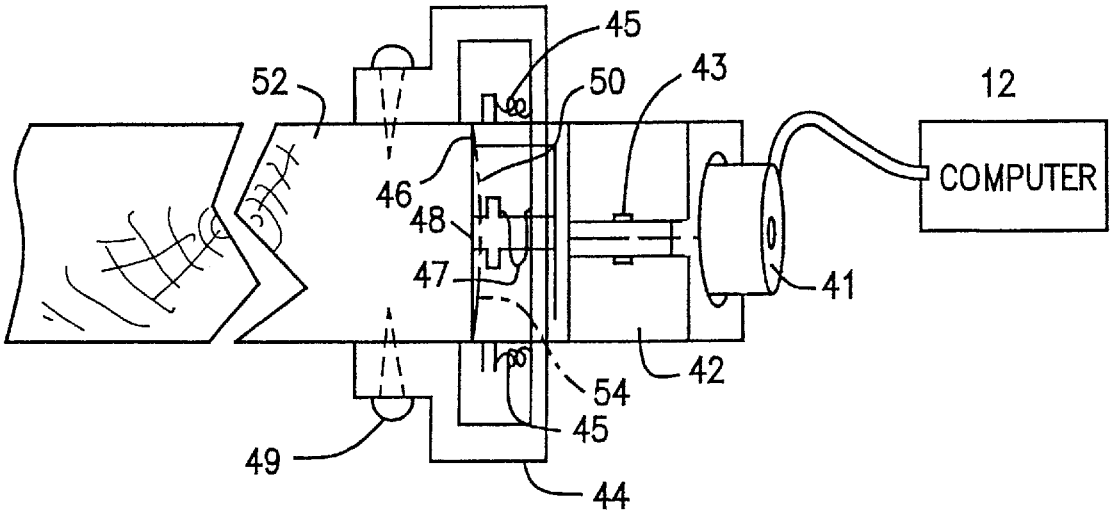
FIG. 5 is a side elevation view of a second embodiment of the apparatus of the present invention.
Figure 6:
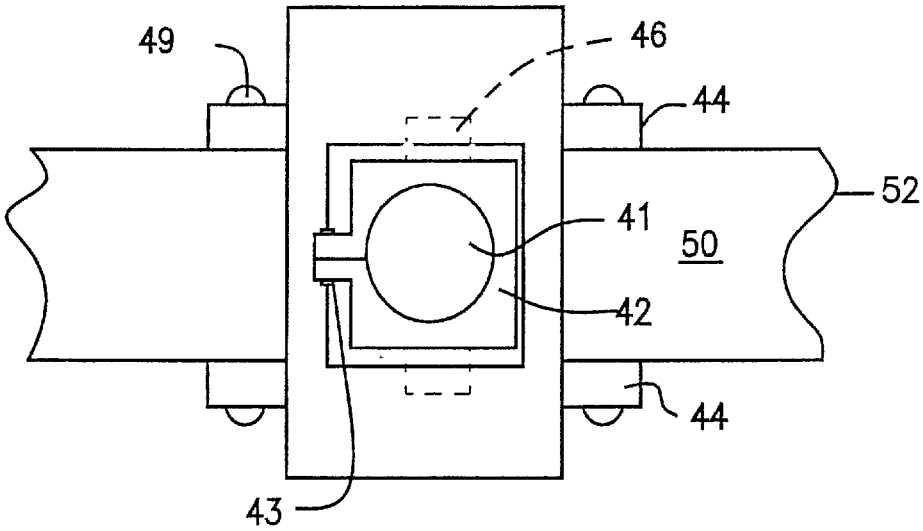
FIG. 6 is a board edge view of the apparatus of FIG. 5.
Figure 7:
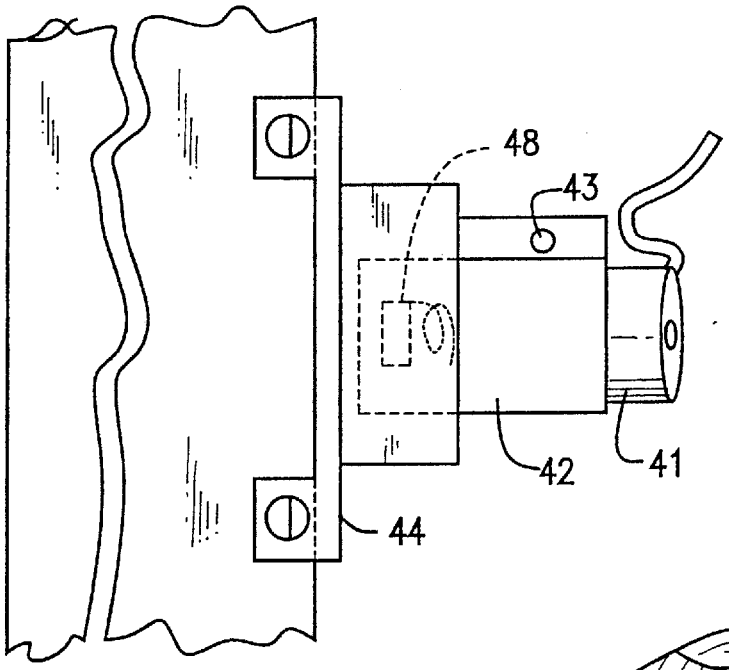
FIG. 7 is a top view of the apparatus of FIG. 5.
Figure 17:
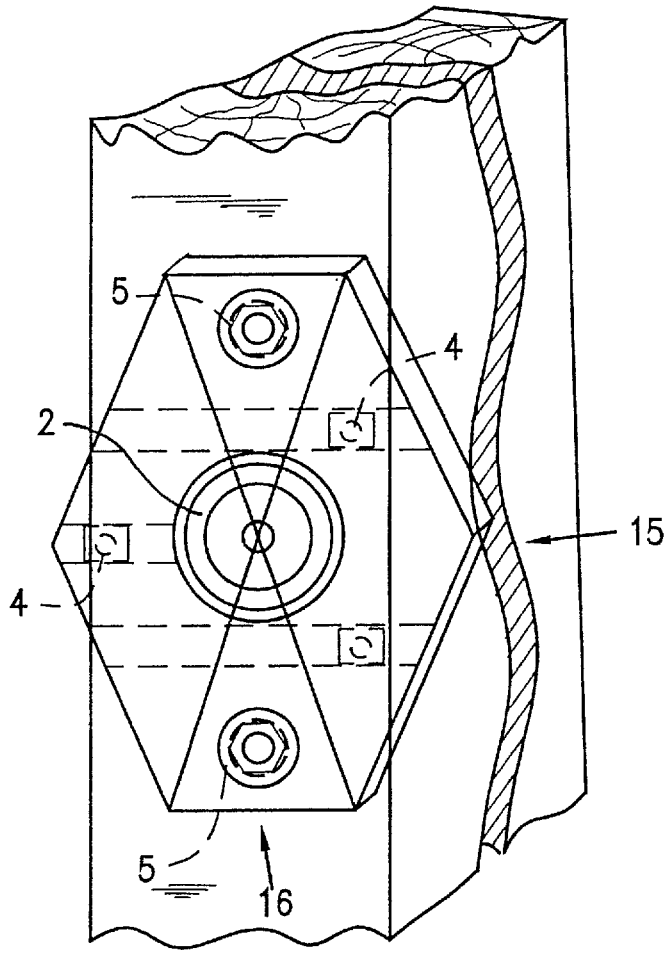
(PRIOR ART) FIG. 17
FIG. 17 is an edge of board view of the prior art device.

FIGS. 5–7 illustrate an alternative measuring device to obtain the same information. This would monitor the "barreling" or bulging of the edge. An LVDT 41 is held in a holder 42 by a set screw 43. The holder 42 is mounted onto the lumber by a flexible mounting bracket 44 to allow for thickness shrinkage. Springs 45 ensure that reference feet 46 are maintained in contact with the edge 50 of the lumber board 52. A spring 47 ensures that the LVDT core rod 48 maintains contact with the center of the side edge of the lumber. The relative movement between the reference feet 46 and core rod 48 results from the "barreling" shown schematically by lines 54 in FIG. 5, and is the input to the computer 12. Screws 49 hold bracket 44 to the face of the board.

Statistical Analysis

The shrinkage data is gathered every hour from the LVDT's. Because fan reversal in a kiln is every six hours and causes swelling for half the cycle, the data was averaged on a running 12 hour basis to smooth the shrinkage curve out. From this data, two slopes of the shrinkage curve are calculated. One is a long term slope which is calculated by taking the slope of a segment in the curve in which one end point of the segment is at a time when the drying was initiated, and the other end point is the point on the curve of interest. The second, short term slope is calculated by taking a shorter segment where one end point is located again at the point of interest, with the other end point a short time previously on the curve. The length of this long term segment depends on where in the drying schedule the point of interest is and the type of species. For example, for the first step in drying oak, the segment is five days long whereas after the first step it is 24 to 12 hours long. For maple, the long term segment would be shorter since it dries faster. One standard deviation is added to the long term slope data set and a second curve is constructed. One standard deviation is subtracted from the short term slope and a third curve is constructed.

Any changes in slope of the curve is detected when the short term slope crosses and becomes greater than the long term slope. See points A, B and C in FIG. 14 for example. This is on the principle that the short term slope will react faster than the long term slope and becomes greater when the original curve has a sudden increased slope.

This process will detect when the point of peak stress has been passed and stress reversal occurs. To detect when shrinkage has reduced sufficiently in succeeding steps, the standard deviation is subtracted from the long term slope and the corresponding standard deviation is added to the short term slope. Then, when the short term slope crosses and becomes less than the long term slope, the kiln drying schedule can be advanced. All this is easily developed into the computer program to automate the process.

Features of the invention

1) Peak stress level and stress reversal points are detected by an abrupt change in slope in the shrinkage curve. It is the stress level within the lumber which is the origin of drying defects and is the limiting factor in the rate of drying quality lumber, not moisture content as is presently used as the decision parameter. With the present invention, moisture content monitoring is not used.
2) With the stress level monitored, the present invention has the ability to advance the kiln schedule before moisture content methods would indicate, thereby saving time, energy, and material loss due to human error.
3) Quality is not sacrificed but improved in two ways. first, as demonstrated by the pilot study, the amount of surface checking and honeycomb produced is no more severe than moisture content controlled drying because the defect causing stresses are what is monitored and maintained below a critical level. Second, with the ability to monitor the stress level, stresses can be maintained high but just below the critical level. This allows for a scheduled step to be avoided to save time and maximize stress relief during equalization and condition. Stress relief occurs during equalization because the lumber is relatively cool compared to the kiln atmosphere, the EMC difference at the lumber surface is actually greater than 9%, promoting stress relief.
4) The statistical method is easily programmed using known computing techniques to automate the decision making and advance the kiln schedule.
5) Confidence. The invention does not rely on a poor indicator (moisture content) but on an actual material response to internal stresses as the control parameter. The LVDT is an appropriate instrument to use for the invention, however, any strain measuring instrument which can withstand the kiln environment can be used. The data obtained and how it is used are the essential features of the invention.

While a specific embodiment of the invention has been shown and described in detail to illustrate the application of the principles of the invention, it will be understood that the invention may be embodied otherwise without departing from such principles.

What is claimed is:

1. A real-time process for controlling conditions in a lumber drying kiln, comprising:

selecting a board of lumber having upper and lower surfaces, opposite side edges and opposite ends to use as a sample of lumber;

measuring shrinkage of the sample of lumber in the kiln, over time, the shrinkage being indicative of stress in the sample;

taking a long-term slope of a curve plotting shrinkage against time;

taking a short-term slope of the curve plotting shrinkage against time;

a point at which the long-term and short-term slopes cross each other, corresponding to the occurrence of stress peak or reversal;

changing the conditions in the kiln when the stress peak or reversal has occurred, to advance the drying of the lumber.

2. A process according to claim 1, wherein changes of the conditions in the kiln are made according to multiple steps in a drying schedule, the process including changing to the next step in the drying schedule when the stress peak or reversal has occurred.

3. A process according to claim 2, including characteristic is shrinkage, the process including advancing subsequent steps based on reduced shrinkage.

4. A process according to claim 3, wherein the sample of lumber has a longitudinal axis, the process including measuring the shrinkage transverse to the longitudinal axis at a location spaced from the ends of the sample.

5. A process according to claim 3, wherein the sample has opposite ends, the process including measuring the shrinkage at a side edge of the sample.

6. A real-time process for controlling conditions in a lumber drying kiln, comprising:

selecting a board of lumber having a longitudinal axis, upper and lower surfaces, opposite side edges and opposite ends to use as a sample of lumber;

applying an apparatus for measuring shrinkage transversely to the longitudinal axis and from one opposite side edge of the sample to the other opposite side edge of the sample, the apparatus being applied to the upper surface or the lower surface of the sample and away from the opposite edges and away from the opposite ends of the sample;

measuring shrinkage of the sample across the upper surface or the lower surface and in the kiln, the shrinkage being measured over time using the apparatus and the shrinkage being indicative of stress in the sample;

the analyzing of the shrinkage comprising taking a slope of a curve plotting shrinkage against time, a change in the slope representing a stress peak or reversal; and changing the conditions in the kiln when the stress peak or reversal has occurred to advance the drying of the lumber.

7. A process according to claim 1, including measuring shrinkage across a longitudinal axis of the board, between opposite side edges of the board.

8. A process according to claim 1, including measuring the shrinkage of the board at one of the opposite side edges of the board.

9. A process for controlling a lumber drying kiln, operated according to a drying schedule having a plurality of steps with different conditions for the drying kiln during each step, comprising:

detecting the occurrence of a stress peak or reversal in a sample of the lumber;

controlling the conditions of the kiln by moving from one step in the schedule to the next step upon the occurrence of the stress peak or reversal;

detecting the stress reversal by measuring shrinkage in the sample, and analyzing the shrinkage over time as indication of the stress peak or reversal; and plotting long-term and short-term curves for the stress per unit time and determining when the curves cross each other to indicate an occurrence of stress peak or reversal in the sample.

10. An apparatus for real-time control of a lumber drying kiln operating according to a schedule having different steps each for different conditions in the kiln, comprising:

means for measuring shrinkage of a sample of the lumber in the kiln;

means for plotting a curve representing change in the shrinkage per unit time;

means for analyzing a slope of the curve for determining the occurrence of a stress peak or stress reversal in the lumber sample; and means for incrementing the schedule from one step to a subsequent step upon the occurrence of stress peak or stress reversal in the sample;

the means for measuring the shrinkage comprise means for measuring shrinkage across a longitudinal dimension of the sample, between opposite side edges of the lumber sample.

11. An apparatus for real-time control of a lumber drying kiln operating according to a schedule having different steps each for different conditions in the kiln, comprising:

means for measuring shrinkage of a sample of the lumber in the kiln;

means for plotting a curve representing change in the shrinkage per unit time;

means for analyzing a slope of the curve for determining the occurrence of a stress peak or stress reversal in the lumber sample; and means for incrementing the schedule from one step to a subsequent step upon the occurrence of stress peak or stress reversal in the sample;

the means for analyzing comprising means for plotting long-term and short-term shrinkage per unit time, and means for detecting a point at which the long-term and short-term curves cross each other, which indicates the occurrence of a stress peak or stress reversal in the sample.

12. An apparatus according to claim 11, wherein the means for measuring shrinkage comprise a pair of brackets each anchored to a surface of the sample, a transducer connected to one bracket and an actuator extending from the transducer and fixed to the other bracket, shrinkage of the board causing relative displacement between the transducer and the rod for measuring the shrinkage.

13. An apparatus according to claim 11, wherein the means for measuring shrinkage comprise a bracket connected to an edge of the lumber sample, a transducer facing the edge of the sampler, an actuator extending from the transducer and engaged with the edge of the lumber sample, and means for fixing the bracket with respect to surface areas of the edge of the lumber sample.

14. An apparatus for real-time control of a lumber drying kiln operating according to a schedule having different steps each for different conditions in the kiln, comprising:

means for measuring shrinkage of a sample of the lumber in the kiln;

means for plotting a curve representing change in the shrinkage per unit time;

means for analyzing a slope of the curve for determining the occurrence of a stress peak or stress reversal in the lumber sample; and means for incrementing the schedule from one step to a subsequent step upon the occurrence of stress peak or stress reversal in the sample;

the means for measuring shrinkage comprising a pair of brackets spaced from each other transverse to a longitudinal axis of the samples each anchored to a side surface of the sample, a transducer connected to one bracket and an actuator extending from the transducer and fixed to the other bracket, shrinkage of the board causing relative displacement between the transducer and the rod for measuring the shrinkage.

* * * * *